US012275120B2

(12) United States Patent
McLain

(10) Patent No.: US 12,275,120 B2
(45) **Date of Patent: *Apr. 15, 2025**

(54) BUFFING SPHEROCYLINDER MADE OF COMPRESSED MATERIAL

(71) Applicant: Lake Country Manufacturing, Inc., Oconomowoc, WI (US)

(72) Inventor: Scott S. McLain, Mukwonago, WI (US)

(73) Assignee: Lake Country Manufacturing, Inc., Oconomowoc, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/355,151

(22) Filed: Jul. 19, 2023

(65) Prior Publication Data

US 2023/0356363 A1 Nov. 9, 2023

Related U.S. Application Data

(63) Continuation of application No. 16/173,227, filed on Oct. 29, 2018, now Pat. No. 11,745,311.

(51) Int. Cl.

| | |
|---|---|
| ***B24D 3/34*** | (2006.01) |
| ***B24B 37/24*** | (2012.01) |
| ***B24D 13/10*** | (2006.01) |
| ***B24D 13/12*** | (2006.01) |
| ***B24D 18/00*** | (2006.01) |

(52) U.S. Cl.

CPC ..... *B24D 3/346* (2013.01); *B24D 13/10* (2013.01); *B24D 13/12* (2013.01); *B24B 37/245* (2013.01); *B24D 18/0009* (2013.01)

(58) Field of Classification Search

CPC ..... B24D 3/346; B24D 13/10; B24D 13/12; B24D 18/0009; B24B 37/245

See application file for complete search history.

(56) References Cited

U.S. PATENT DOCUMENTS

| | | | |
|---|---|---|---|
| 574,449 | A | 1/1897 | Pritschau |
| 1,517,859 | A | 12/1924 | O'Shea |
| 1,523,842 | A | 1/1925 | Schroeder |
| 1,713,975 | A | 5/1929 | Mayer |
| 1,819,800 | A | 8/1931 | Turner |
| 1,995,808 | A | 3/1935 | Homon |
| 2,478,232 | A | 8/1949 | Boynton |
| 3,020,139 | A | 2/1962 | Camp et al. |
| 3,026,552 | A | 3/1962 | Price |
| 3,204,277 | A | 9/1965 | Sierik et al. |
| D202,875 | S | 11/1965 | Ganske |
| 4,177,611 | A | 12/1979 | Carr-Rollett |
| 4,199,835 | A | 4/1980 | Heyer et al. |

(Continued)

*Primary Examiner* — Pegah Parvini

(74) *Attorney, Agent, or Firm* — Harness, Dickey & Pierce, P.L.C.

(57) ABSTRACT

A buffing and polishing member has an uncompressed monolithic body of foam material having slits from an outside surface toward and less than a distance to a rotational axis of the body. The slits, on circumferential spaced planes, extend generally radially from the outside surface toward and less than a distance to the rotational axis to define a plurality of foam fingers and an unslit center portion. A fastening mechanism holds the center portion of the slit foam body in a compressed state along the rotational axis such that the uncompressed outer ends of the foam finger define a spherocylinder.

9 Claims, 4 Drawing Sheets

(56) References Cited

U.S. PATENT DOCUMENTS

| | | | | |
|---|---|---|---|---|
| 4,457,038 | A | 7/1984 | Hammond | |
| D317,489 | S | 6/1991 | Stillinger | |
| 5,235,717 | A | 8/1993 | Lanzo et al. | |
| D353,940 | S | 1/1995 | Joyner et al. | |
| D364,716 | S | 11/1995 | Lazar | |
| 5,548,862 | A | 8/1996 | Curtis | |
| D378,536 | S | 3/1997 | Fireman et al. | |
| D381,380 | S | 7/1997 | Fireman et al. | |
| 5,938,515 | A | 8/1999 | McLain et al. | |
| D422,207 | S | 4/2000 | Mendis | |
| D425,276 | S | 5/2000 | George | |
| 6,098,236 | A | 8/2000 | Chen | |
| 6,105,196 | A | 8/2000 | Chang | |
| 6,131,234 | A | 10/2000 | Chen | |
| 6,227,621 | B1 | 5/2001 | Chen | |
| 6,589,107 | B2 | 7/2003 | Lee | |
| 6,748,620 | B2 | 6/2004 | Ching-Chen | |
| 6,754,931 | B2 | 6/2004 | Chen | |
| 7,152,269 | B1 | 12/2006 | Windel | |
| 7,203,989 | B2 * | 4/2007 | McLain | A46B 13/001 15/97.1 |
| D560,458 | S | 1/2008 | McLain | |
| 7,669,939 | B2 * | 3/2010 | McLain | A46B 13/001 15/97.1 |
| 8,029,070 | B2 * | 10/2011 | McLain | B24D 13/12 15/97.1 |
| 11,745,311 | B2 * | 9/2023 | McLain | B24D 13/12 451/527 |
| 2003/0131429 | A1 | 7/2003 | Ching-Chen | |
| 2003/0208871 | A1 | 11/2003 | Osborne | |
| 2004/0148721 | A1 | 8/2004 | Spaulding | |
| 2005/0000046 | A1 | 1/2005 | Popovsky et al. | |
| 2005/0120500 | A1 | 6/2005 | McLain | |
| 2005/0188491 | A1 | 9/2005 | McLain | |
| 2006/0225236 | A1 | 10/2006 | Chang | |
| 2006/0282966 | A1 | 12/2006 | Popovsky et al. | |
| 2007/0067934 | A1 | 3/2007 | Osborne | |
| 2007/0186365 | A1 | 8/2007 | Armaly, Jr. | |
| 2020/0130142 | A1 | 4/2020 | McLain | |

* cited by examiner

BUFFING SPHEROCYLINDER MADE OF COMPRESSED MATERIAL

CROSS REFERENCE TO RELATED APPLICATIONS

This application is a continuation of U.S. patent application Ser. No. 16/173,227, filed Oct. 29, 2018. This application incorporates by reference herein the entire disclosure of U.S. patent application Ser. No. 29/668,184, filed on Oct. 29, 2018. The entire disclosures of each of the above applications are incorporated herein by reference.

FIELD

The present invention pertains to a rotating buffing device adapted to be attached to and driven by a power operating tool or the like and, more particularly, to a buffing tool made at least partially of a plastic foam piece that is slit and compressed to form a spherocylinder for buffing, polishing and finishing a painted surface.

BACKGROUND

Foam buffing pads are well known in the art and typically comprise circular, general flat face pads attached to a circular packing plate which, in turn, is attached to a rotary or orbital power operate tool. It is also known to make foam buffing pads by attaching a dense array of individual plastic foam fingers to a backing substrate such as known and disclosed in U.S. Pat. No. 5,938,515. It is also known to make a buffing pad from a stack of thin circular layers of a cloth material, such as felt, that are slit radially inward from their outer edges and clamped axially such that the layers take on a somewhat spherical shape comprising an array of cloth fingers. The ball is mounted for rotation on the axis along the cloth layers and are pressed together to provide a generally buffing ball.

U.S. Pat. Nos. 8,029,070; 7,669,939 and 7,203,989, all of which are assigned to the Assignee of the current application and are hereby incorporated by reference, relate to buffing balls made of compressible materials. These buffing balls are made of compressible material and are adapted to be driven on a rotational axis. While these buffing balls work satisfactorily for their intended purpose, designers strive to improve the art.

SUMMARY

According to the disclosure, a buffing and polishing member of compressible foam material mounted to be driven on a rotatable axis comprises an uncompressed monolithic body of foam material. Slits are formed on an outside surface toward and less than a distance to a rotational axis of the body. The slits are circumferential spaced planes extending generally radially from the outside surface toward and less than a distant to the rotational axis to define a plurality of foam fingers and an unslit center portion. A fastener mechanism member holds the center portion of the slit foam body in a compressed state along the rotational axis. In this state, the uncompressed outer ends of the foam fingers define a spherocylinder. The axial ends of the foam body are hemi-spherically shaped. The uncompressed fingers of the foam body between the hemi-spherical ends define a cylindrical shape. The foam body, in an uncompressed state, has a through bore with a first diameter and a second larger diameter. The fastening mechanism has a stem with a head portion and a snap fastener. The head portion has a diameter larger than the diameter of the bore second diameter. The snap fastener includes a male snap and a female snap that interlock with one another. The stem includes a spindle projecting from the head portion. A flange radially projects from the stem. A washer, with a diameter larger than the flange, is secured onto the spindle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
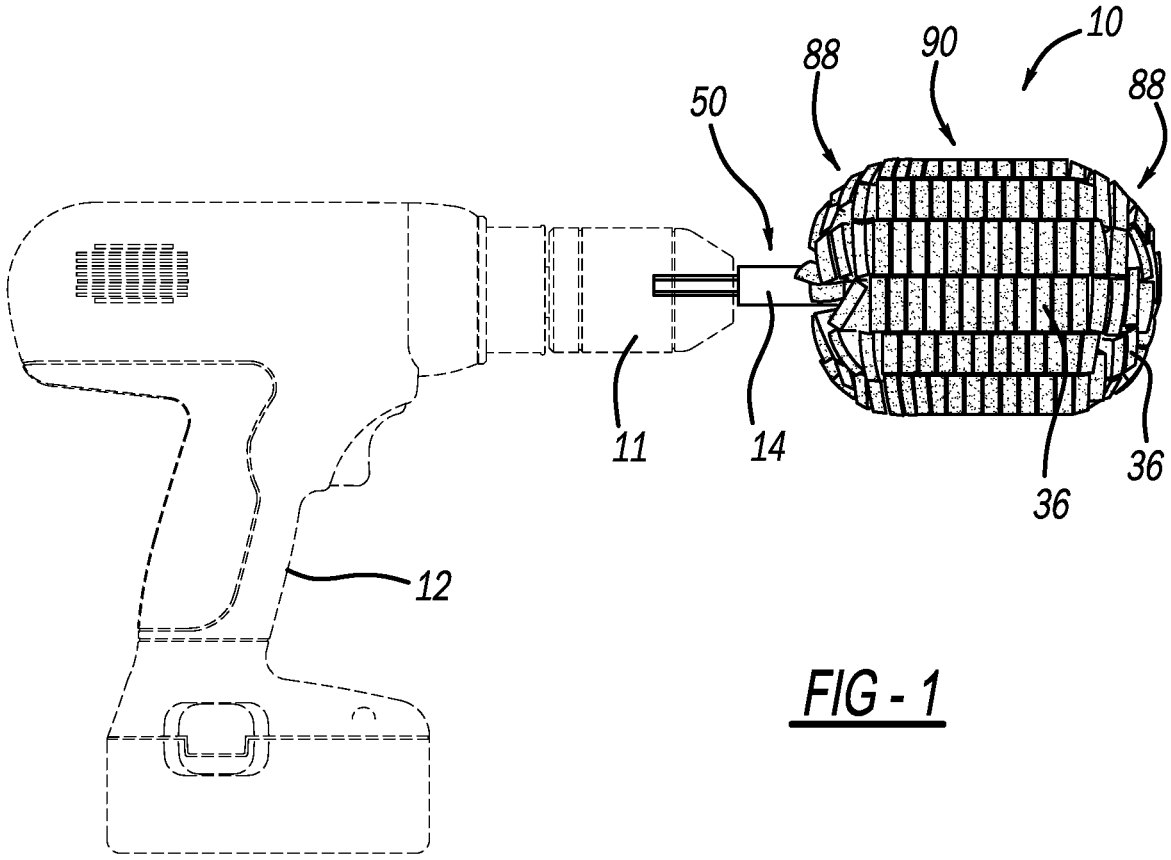
FIG. 1 is a side elevation view of a buffing device in accordance with the present disclosure.

Turning to the figures, the foam buffing and polishing spherocylinder 10 is illustrated. In FIG. 1, the spherocylinder 10 is mounted on the chuck 11 of a driving tool 12 to rotate the spherocylinder about its rotational axis. A spindle 14 is connected to the chuck 11 of the driving tool. The remainder of the fastening mechanism 50 used to compressed and fasten the buffing and polishing spherocylinder 10 is contained within the interior of the spherocylinder and not normally visible.

The buffing spherocylinder 10 of the preferred embodiment is made from a monolithic cylindrical foam body 16 that may be of an suitable polymeric foam material typically used in buffing and polishing pads for various surface finishing operations. For example, an open cell polyurethane foam which may be reticulated or unreticulated is one suitable and presently preferred material. The cylindrical foam body 16 includes a central through bore 18 on the axis of the cylindrical body. The bore 18 has a first portion 19 and a second larger diameter portion 20. The bore 18 provides the axis for the compressing and fastening system 50 to be described and also comprises the rotational axis of the completed spherocylinder 10.

Figure 5:
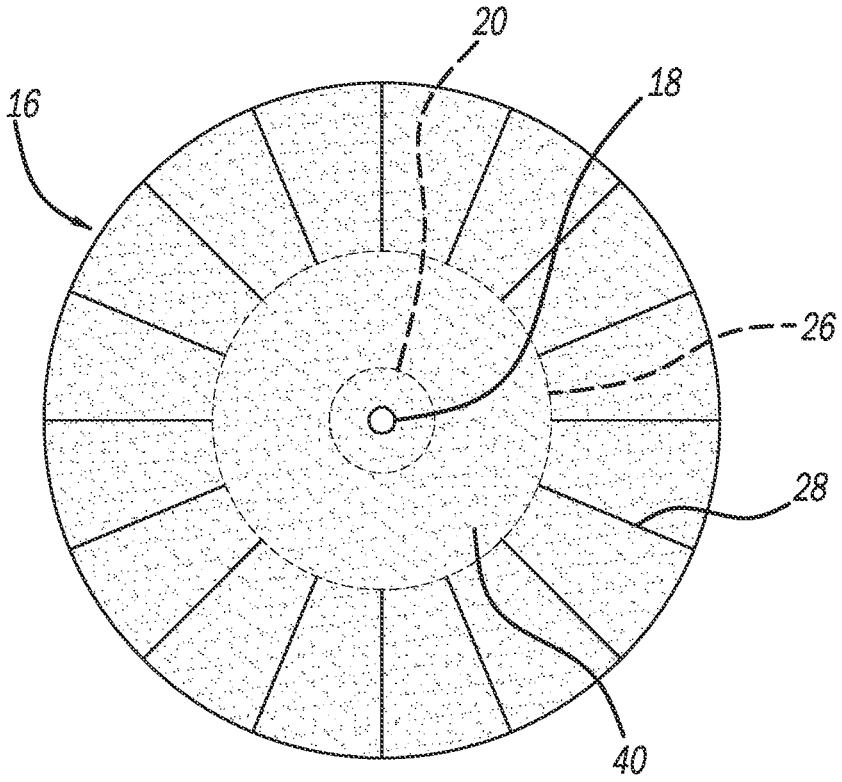
FIG. 5 is a plan view of the foam cylinder of FIG. 4.

The cylindrical foam body 16 is slit from an outside surface in a direction generally perpendicular to the axis of the bore 18 and is further slit from the outside surface on circumferentially spaced generally radially extending planes which include the rotational axis, and may be generally perpendicular to the first slits. A single spiral slit 22 provides a slit that is generally perpendicular to the through bore 18 (which also coincides with the rotational axis of the polishing spherocylinder 10). The spiral slit 22 essentially provides a series of axially spaced foam layers 24. The pitch angle of the spiral slit 22 is very small such that, for example, in a cylindrical foam body 16 having an axial length of about 5 inches (about 125 mm), there may be about 25 layers 24. However, the pitch angle may be varied and, correspondingly, the number of foam layers. The spiral slit 22, in the preferred embodiment, extends to a depth of about half the radius of body 16, as shown in the slit termination line 26 in FIG. 5. However, the depth of the spiral slit 22 may be varied considerably.

The radial slits 28 which also extend inwardly from the outside surface of the foam body 16 preferably lie in planes that commonly intersect on the rotational axis defined by the bore 18. In the embodiment shown, there are 16 radial slits which, if equally spaced, are 22.5° rotationally apart from one another. However, the number of radial slits may also vary considerably. The foam body 16 has a diameter of about 4 inches (about 100 mm), the slits 28 are about the same depth as the spiral slit 22, namely, about 1.25 inches (about 30 mm). The resultant slit foam body 16 is provided with an outer cylindrical surface defined by the rectangular outer ends 30 of an array of foam fingers 36.

The spiral slit 22 is preferably made with a cutting blade brought into surface contact with the cylindrical body 16 as the body is rotated and simultaneously translated axially. The radial slits 28 are preferably made with a water jet cutter. The through bore 18 is also preferably made with the same water jet cutter. The function of the through bore 18 will be described hereinafter.

Figure 2:
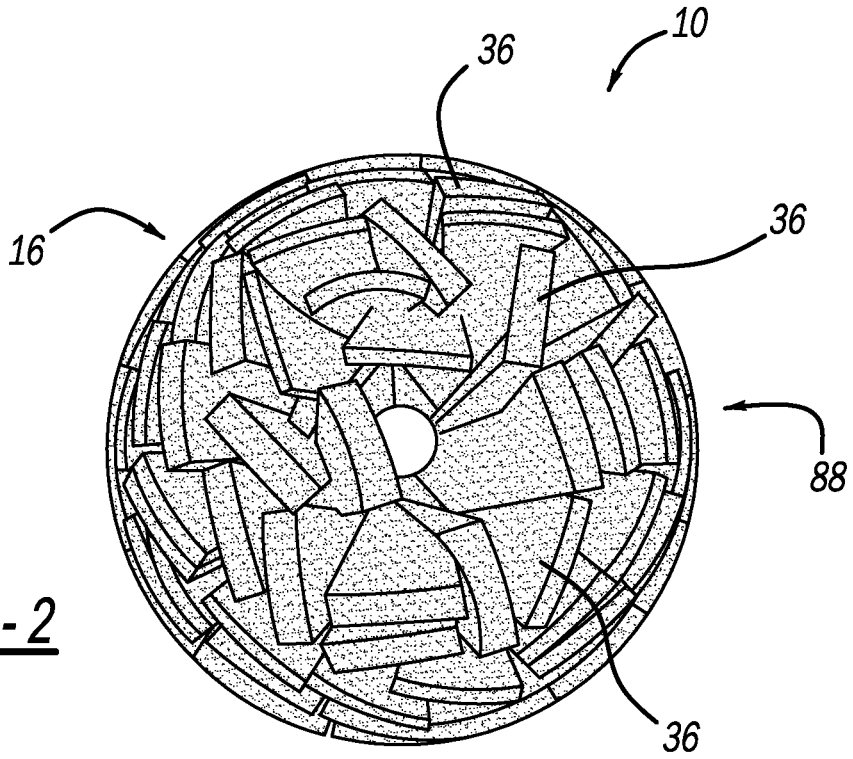
FIG. 2 is a plan view of an end of the buffing device.
Figure 3:
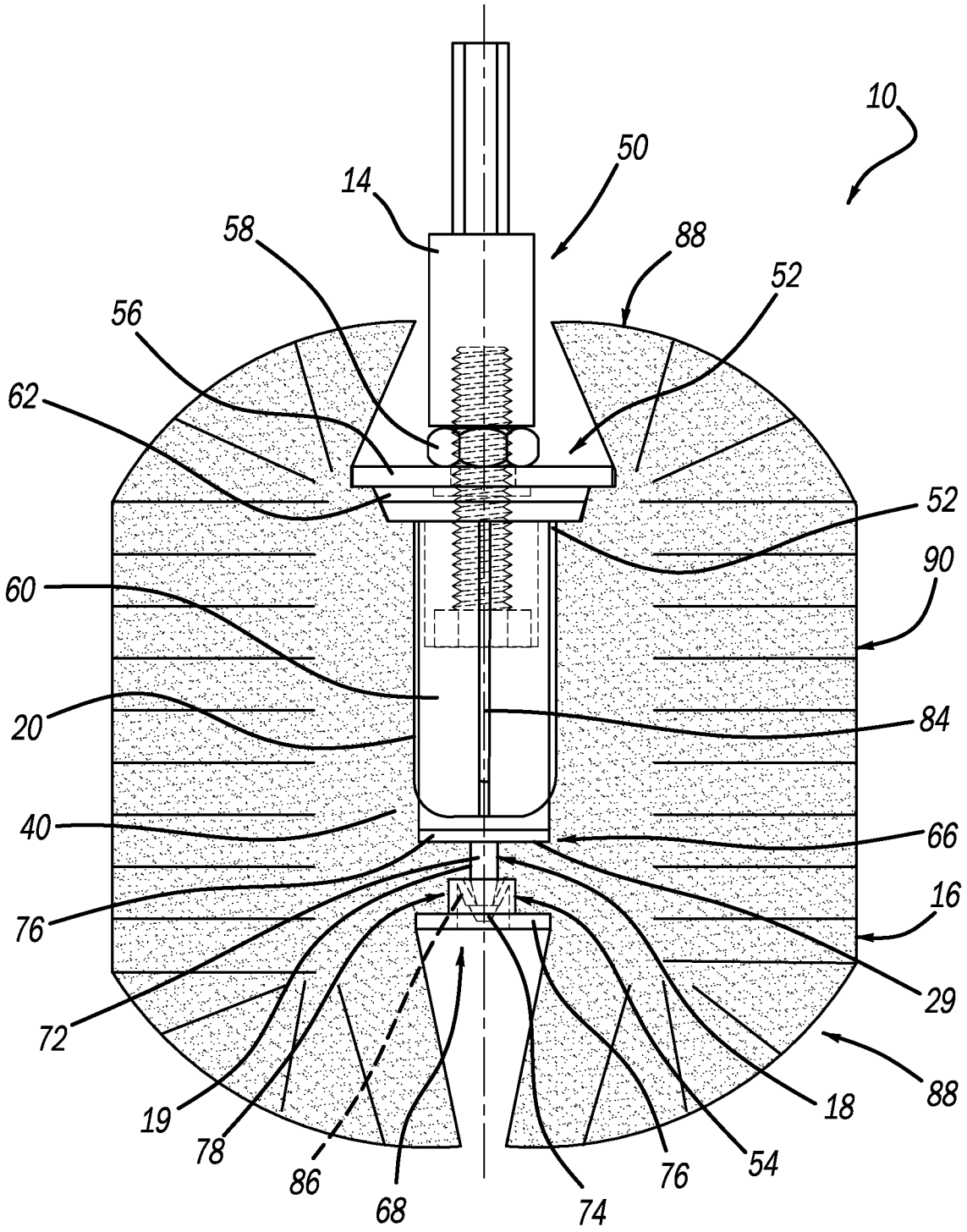
FIG. 3 is a cross-section view of the device of FIG. 1.

Referring particularly to FIGS. 1-3, the cylindrical foam body 16 is compressed axially and held in a manner that causes the center portion 40 of the body to be compressed and held while the foam fingers 36 are deformed in a manner such that the rectangular outer ends 30, through distorted somewhat, together assume a generally hemi-spherical shape. The fastening mechanism 50 includes a stem 52, a snap fastener 54, a washer 56, nut 58 and spindle 14. The stem 52 has a head 60, flange 62 and threaded shank 64. The head 60 has an overall cylindrical shape with a rounded or dome end 61. The diameter of the head 60 is slightly larger than the diameter of the second portion 20 of the bore 18. Thus, the head 60, when it is inserted into the second portion 20 of the bore 18, compresses the foam body 16. The shank 64 is generally that from a bolt 65 that is embedded in the head 60. The stem 52 is generally formed from injection molding process. Thus, the bolt head 67 is molded within the head 60 and enables the threaded shank 64 to project from the stem 52. A flange portion 62 is positioned at the other end of the head 60. The flange portion 62 provides a flat seat for the washer 56.

The snap fastener 54 includes a male snap 66 and a female snap 68. The male snap 66 includes a flange 70 and a projecting portion 72 with a stepped or barb head portion 74. The female snap 68 includes a flange 76 and a receiver 78. The receiver includes a plurality of fingers 80, that define an aperture 82, that receive the projection 72 of the male snap 66. The head 74 passes through the fingers 80 and is locked at the step portion 79 by the fingers of the female snap receiver 78 as shown in FIG. 3.

Figure 4:
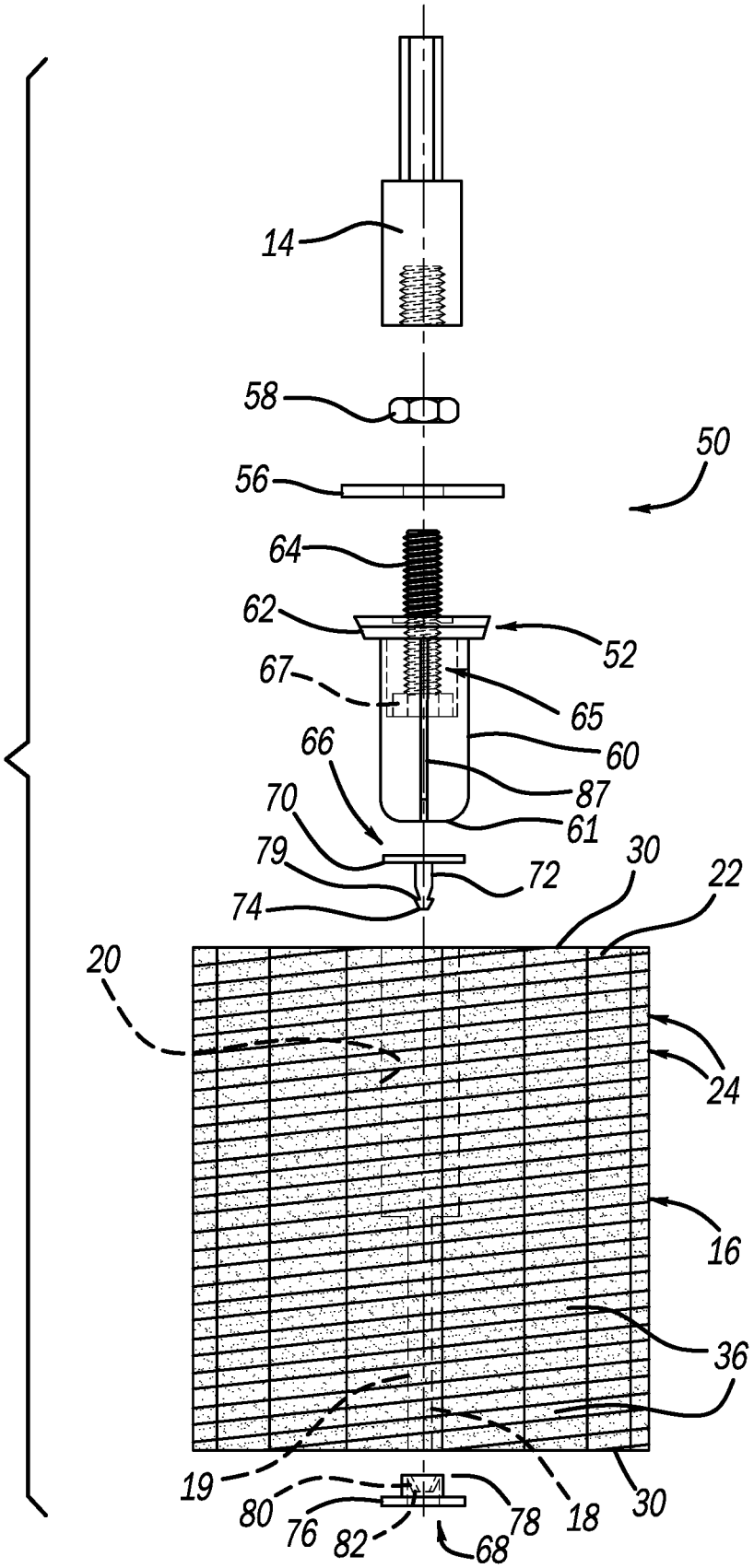
FIG. 4 is an exploded view of the device of FIG. 3.

In the uncompressed state, the foam body 16 has an overall cylindrical shape as illustrated in FIG. 4. The male snap 66 is pressed into the second diameter portion 20 of the bore 18. The flange 70, which has a diameter substantially equal to the second diameter bore portion 20, seats against the step 29 between the first 19 and second 20 diameter portions of the bore 18. Also, the projection 72 projects into the first portion 19 of the bore 18. Glue (not shown) is inserted into the second diameter bore portion 20 after the male snap 66 is inserted into the bore 20. The stem 52 is inserted with the second diameter portion 20 after the glue. The stem head 60 has slots 84 that enable the glue to disperse and pass around the head 60. The head 60 is continued to be inserted into the second bore portion 20 until it abuts the male snap 66. As this occurs, the female snap 68 is inserted into the first bore portion 19 of the foam body 16. The female snap 68 is inserted until the receiving portion fingers 80 interlock with the male snap head 74 as illustrated in FIG. 3. Also, the washer 56 is placed onto the threaded shank 64 and the nut 58 with the spindle 14 is threaded onto the shank to secure the washer 56 against the flange 62. The washer 56, as well as the flange 76, form a stop for the foam body in the compressed state (see FIG. 3). A conical aperture radiates from the washer 56 and flange 76 to form the hemispherical ends of the spherocylinder 10. The spherocylinder 10 has an overall length of approximately 5". Each hemispherical end 88 is approximately an inch long. Thus, the cylinder portion 90 is approximately 3". However, the cylindrical portion can range between 40% to 80% of the spherocylinder cylinder.

Thus, the cylindrical portion is substantially smooth providing a right cylindrical surface for buffing and polishing. This enhances the performance of the present buffing and polishing spherocylinder.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A buffing and polishing member of compressible foam material mounted to be driven on a rotatable axis comprising:

an uncompressed monolithic body of foam material having a plurality of foam fingers and a center portion, the foam body, in an uncompressed state, includes a through bore having a first diameter portion and a second larger diameter portion, and a fastening mechanism positioned in both the first and second bore diameter portions for holding the center portion of the foam body in a compressed state along the rotational axis such that the uncompressed outer ends of the foam fingers define a spherocylinder.

2. The buffing and polishing member of claim 1, wherein the fastening mechanism further comprising a stem with a head portion, having a diameter larger than the diameter of the bore second diameter portion, and a snap fastener.

3. The buffing and polishing member of claim 2, wherein the snap fastener includes a male snap and a female snap interlocking with one another.

4. The buffing and polishing member of claim 2, wherein the stem includes a spindle.

5. The buffing and polishing member of claim 2, wherein a flange radially projects from the stem.

6. The buffing and polishing member of claim 2, wherein a washer, with a diameter larger than the flange, is secured onto a spindle.

7. A buffing and polishing member of compressible foam material mounted to be driven on a rotatable axis comprising:

an uncompressed monolithic body of foam material having a plurality of foam fingers, a center portion and a fastening mechanism adhesively secured in a bore in the foam body for holding the center portion of the foam body in a compressed state along the rotational axis such that the uncompressed outer ends of the fingers define a spherocylinder.

8. A buffing and polishing member of compressible foam material mounted to be driven on a rotatable axis comprising:

an uncompressed monolithic body of foam material having a plurality of foam fingers, a center portion, and a fastening mechanism for holding the center portion of the foam body in a compressed state along the rotational axis such that the uncompressed outer ends of the fingers define a spherocylinder; and the fastening mechanism further comprising a stem with a head portion, having a diameter larger than a diameter of a bore second diameter portion, and a snap fastener.

9. A buffing and polishing member of compressible foam material mounted to be driven on a rotatable axis comprising:

an uncompressed monolithic body of foam material having a plurality of foam fingers, a center portion, and a fastening mechanism for holding the center portion of the foam body in a compressed state along the rotational axis such that the uncompressed outer ends of the fingers define a spherocylinder; and a snap fastener coupling with the fastening mechanism for compressing the foam, the snap fastener includes a male snap and a female snap interlocking with one another.

* * * * *